US008001626B2

(12) United States Patent
Dalickas

(10) Patent No.: US 8,001,626 B2
(45) Date of Patent: Aug. 23, 2011

(54) SWIMMING POOL SAFETY NET SYSTEM

(76) Inventor: Walter Dalickas, Boca Raton, FL (US)

( * ) Notice: Subject to any disclaimer, the term of this patent is extended or adjusted under 35 U.S.C. 154(b) by 377 days.

(21) Appl. No.: 12/322,012

(22) Filed: Jan. 27, 2009

(65) Prior Publication Data

US 2010/0186159 A1 Jul. 29, 2010

(51) Int. Cl.
*E04H 4/00* (2006.01)

(52) U.S. Cl. ..... 4/504; 4/498

(58) Field of Classification Search ..... 4/494–495, 4/498–501, 503–504; 256/24, 26–27; 114/240 C, 114/240 E, 241; 52/3, 63–64, 69; 220/218
See application file for complete search history.

(56) References Cited

U.S. PATENT DOCUMENTS 559,490 A * 5/1896 Jones ..... 114/241
1,145,806 A * 7/1915 Selby ..... 114/241
1,204,547 A * 11/1916 Corrado et al. ..... 114/241
1,369,289 A * 2/1921 Lyda ..... 441/35
2,825,910 A * 3/1958 Prudek ..... 4/495
2,895,143 A * 7/1959 Seitz ..... 4/500
3,086,219 A * 4/1963 Stafford ..... 4/501
4,601,072 A * 7/1986 Aine ..... 4/499
4,971,217 A * 11/1990 Robertson et al. ..... 220/218
5,168,584 A * 12/1992 Peebles ..... 4/504
5,267,358 A * 12/1993 Roy et al. ..... 4/504

* cited by examiner

*Primary Examiner* — Charles Phillips
(74) *Attorney, Agent, or Firm* — Robert M. Downey, P.A.

(57) ABSTRACT

A swimming pool safety net system includes a net having a first edge affixable to a side of a swimming pool and a second edge extendable toward a center of the swimming pool. A plurality of actuators are substantially regularly spacing around a periphery of a swimming pool wherein each actuator has an extendable end affixed to the second edge of the net. A controller selectively operates the actuators between a retracted position with the second end of the net proximal to the side of the swimming pool and an extended position with the second end of the net extended toward the center of the swimming pool.

31 Claims, 5 Drawing Sheets

SWIMMING POOL SAFETY NET SYSTEM

BACKGROUND OF THE INVENTION

1. Field of the Invention

The present invention relates to swimming pools in general and more particularly to a retractable safety net around the perimeter of a swimming pool.

2. Discussion of the Related Art

Over recent decades, swimming pools have become ever more popular. Public pools are often found as part of a community's recreational facilities and can be both indoor and outdoor pools. Apartment complexes, hotels, and motels also include one or more swimming pools as offered amenities to entice people to reside at their facilities. Swimming pools can often be also found in the back yards of private residences. While some of these pools, particularly some of the public pools, are wading pools, the vast majority are pools that have depths ranging from three to ten feet or more. Such depths can present a danger of drowning to children or individuals who do not know how to swim. Additionally, many residences may be in a transitional state between owners where the previous owned has vacated the property and a new owner is either remotely located or has yet to take up residence at the property. These properties are essentially unattended and become an extra danger to curious and adventuresome children.

Swimming pools present a significant risk of infant and toddler death due to drowning. While communities may require a fence around the pool area, these regulations are usually limited to requiring a fence around the periphery of the property where the pool is located, but not necessarily requiring a fence on the interior perimeter of the pool area. Thus, if a child gains access to the yard, there may be no further barrier to exclude the child from the pool area itself. Pool submersions involving children happen quickly. A child can drown in the time it takes to answer a phone.

In regions where residential pools are common, drowning is a major cause of childhood fatalities. Reports have shown that in parts of the nation's Sunbelt, drowning has been the leading cause of accidental death in the home of children under five years old. The danger of swimming pools is such that 300 children under age five die and 2,000 more children under age five visit hospital emergency rooms for submersion injuries every year. These deaths and injuries occur regardless of the degree of supervision. For instance, at the time of the incidents, most victims were being supervised by one or both parents. Typical statistics show that seventy-seven percent of the victims had been missing from sight for five minutes or less. Forty-six percent of the victims were last seen in the house; twenty-three percent were last seen in the yard or on the porch or patio; and thirty-one percent were in or around the pool before the accident. In all, sixty-nine percent of the children were not expected to be at or in the pool, yet they were found in the water. These statistics are just for children under five years of age.

Because of the significant danger a pool presents, a number of safety measures in the form of barriers are recommended. While barriers are not childproof, they provide layers of protection for a child who strays from supervision. Barriers give parents additional time to locate a child before the unexpected becomes a reality. Recommended barriers include a fence or wall, door alarms for the house, and a power safety cover over the pool. Fences around the pool should be of a construction to prevent children from squeezing through openings or from climbing over the top. Gates leading to the pool area should be self-latching. If the house is part of the barrier, the doors leading from the house to the pool are recommended to be protected with an alarm or the pool should have a power safety cover.

While power safety covers are effective, they must be totally retracted in order to use the pool. Often, pool owners desire to have a pool open to improve the aesthetic atmosphere during parties and such or just to lounge around the pool without entering the water. In those instances, a power pool safety cover becomes a hindrance to its desired use.

Thus what is desired is a pool safety device that protects against accidental submersions while maintaining the aesthetics of an open pool.

SUMMARY OF THE INVENTION

The present invention is directed to a swimming pool safety net system that satisfies the need to protect individual against accidental submersion around the periphery of a swimming pool. The swimming pool safety net system includes a net having a first edge affixed to a side of a swimming pool and a second edge extendable toward a center of the swimming pool. A plurality of actuators are substantially regularly spacing around a periphery of a swimming pool wherein each actuator has an extendable end affixed to the second edge of the net. A controller selectively operates the actuators between a retracted position with the second end of the net proximal to the side of the swimming pool and an extended position with the second end of the net extended toward the center of the swimming pool.

Another aspect of the present invention is a swimming pool safety net system including a net having a first edge affixed to a side of a swimming pool and a second opposite edge selectively extendable and retractable with respect to the first edge. A plurality of linear actuators is arranged along a length of the net. Each linear actuator includes an actuator rod operable between a retracted position and an extended position wherein a distal end of each actuator rod is attached to the second edge of the net. Each linear actuator is secured to an outer perimeter of the swimming pool. A controller is fluidically connected to a swimming pool circulation pump for selectively extending and retracting the net. The controller has a first control inlet connected to a positive pressure outlet of the swimming pool circulation pump for extending the net and a second control inlet connected to a negative pressure outlet of the swimming pool circulation pump for retracting the net. A selector selectively interconnects a net control outlet with one of the first control inlet and second control inlet. A fluid line fluidically connects the net control outlet with each of the linear actuators.

Yet another aspect of the present invention is a safety net system for installation in a swimming pool. The safety net system includes a net having a first edge attached to a retraction reel affixed to a side of the swimming pool and a second opposite edge selectively extendable and retractable with respect to the retraction reel. A plurality of actuators are arranged along a length of the net and secured to an outer perimeter of the swimming pool. The actuators are operable between a retracted position and a vertically extended position. A distal end of each actuator is attached to the second edge of the net such that when the actuators are extended, the net vertically blocks entry into the swimming pool. A net controller is fluidically connected to the swimming pool circulation pump for selectively extending and retracting the net, the net controller has a first net control inlet connected to a positive pressure outlet of the swimming pool circulation pump for extending the net and a second net control inlet connected to a negative pressure outlet of the swimming pool circulation pump for retracting the net. A selector selectively interconnects a net control outlet with one of the first control inlet and the second control inlet. A fluid line fluidically connects the net control outlet with each of the actuators.

These and other features, aspects, and advantages of the invention will be further understood and appreciated by those skilled in the art by reference to the following written specification, claims and appended drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 2:
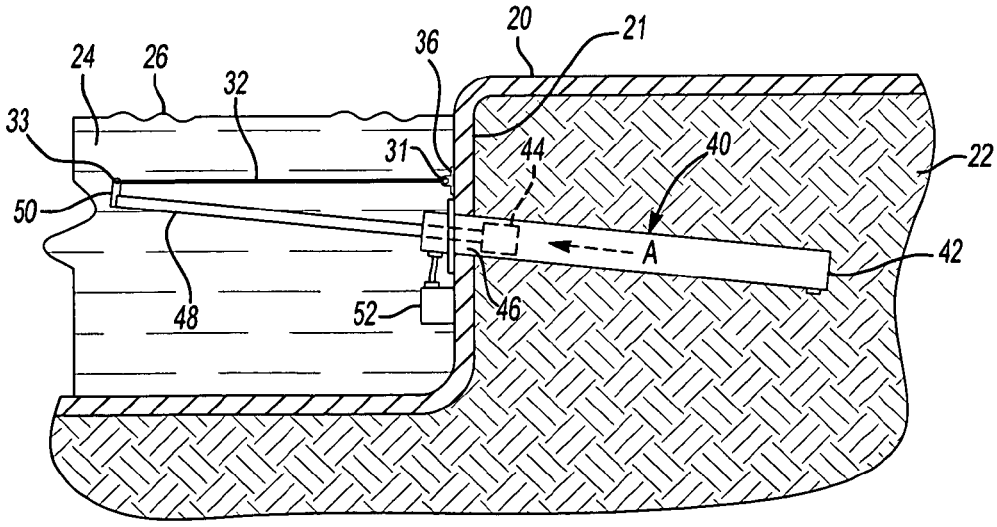
FIG. 2 is a cross-sectional view of an extended cylinder installed in the side of an in-ground swimming pool for the safety net shown in FIG. 1 and taken along the line 2-2, FIG. 1.

For purposes of description herein, the terms "upper", "lower", "left", "rear", "right", "front", "vertical", "horizontal", and derivatives thereof shall relate to the invention as oriented in FIG. 2. However, one will understand that the invention may assume various alternative orientations and step sequences, except where expressly specified to the contrary. While the present invention has been shown and described in accordance with preferred and practical embodiments thereof, one will also recognize that departures from the instant disclosure are fully contemplated within the spirit and scope of the invention. Hence, specific dimensions and other physical characteristics relating to the embodiments disclosed herein are not to be considered as limiting, unless the claims expressly state otherwise.

Turning to the drawings, FIGS. 1-4 show a rectangular in-ground swimming pool 20 having a swimming pool safety net system 30 installed therein which is one of the preferred embodiments of the present invention and illustrate its various components.

Figure 1:
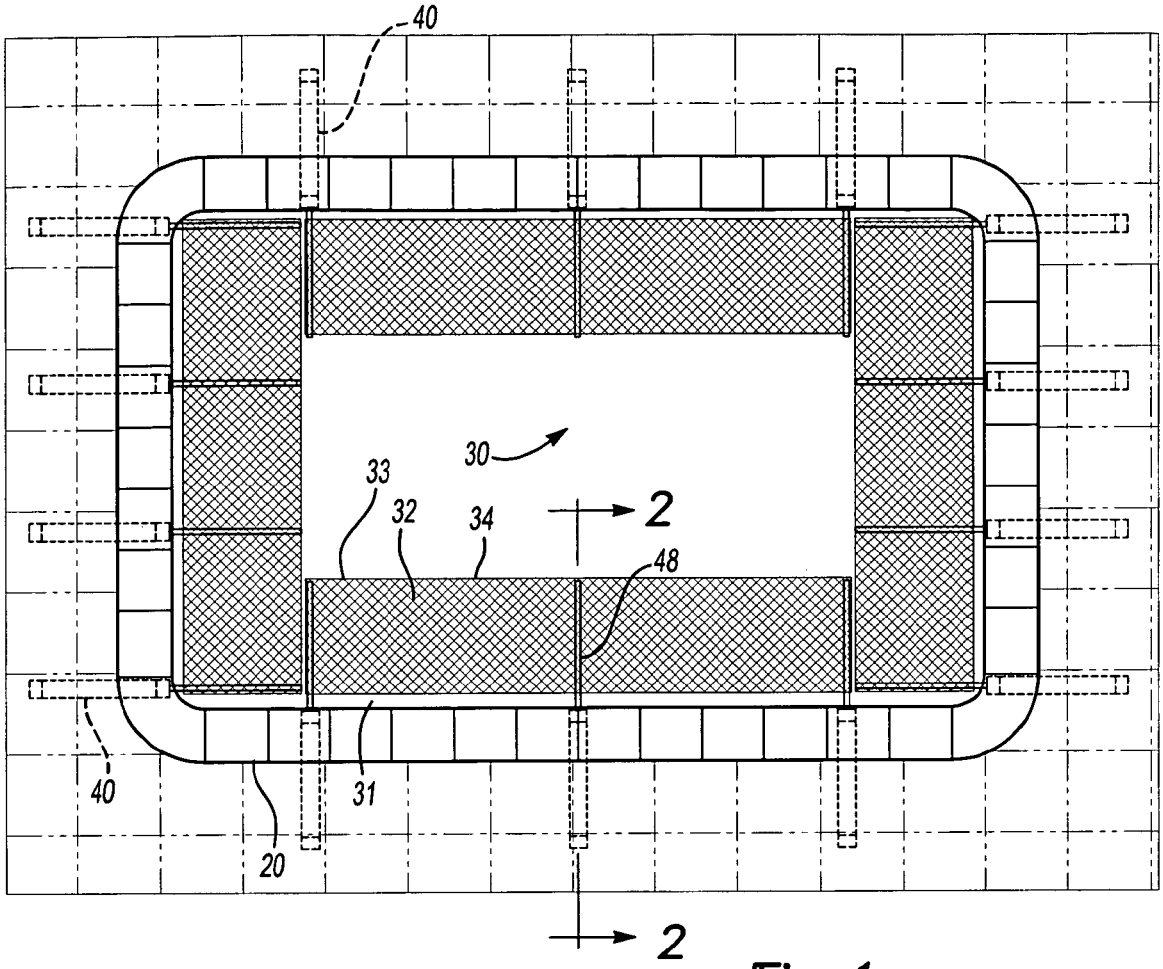
FIG. 1 is a plan view of an in-ground swimming pool having an extendable safety net embodying the present invention, wherein the safety net is in an extended configuration.
Figure 3:
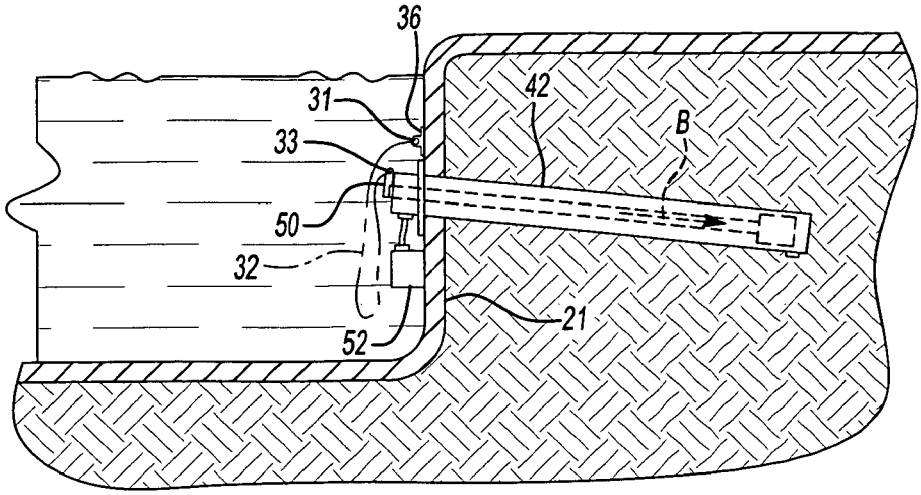
FIG. 3 is a cross-sectional view of the in-ground swimming pool as shown in FIG. 2 with the cylinder in a retracted position.

As illustrated in FIGS. 1-3, swimming pool safety net system 30 includes a plurality of actuators 40 regularly spaced around a periphery of swimming pool 20. As more clearly shown in FIGS. 2-3, actuators 40 extend through swimming pool sidewall 21 below the surface 26 of pool water 24 and are embedded in ground 22 surrounding pool 20. Actuators 40 are linear actuators having a cylinder housing 42 defining a cylinder chamber 46. A piston 44 is closely received in cylinder chamber 46 and is linearly movable therein as indicated by arrow "A" of FIG. 2 and arrow "B" of FIG. 3. An actuator rod 48 is affixed to piston 44 and extends from cylinder housing 42 into swimming pool 20. Actuators 40 utilize swimming pool water 24 as an operating medium which is delivered to and from actuators 40 through fluid distribution line 52. Actuator rod 48 has a distal end 50 which is axially translated distally and proximally with respect to swimming pool sidewall 21 in a selective manner during operation of actuators 40. Actuators 40 are horizontally oriented or, alternatively, are angularly oriented within fifteen degrees of horizontal such that when extended, distal end 50 is closer to surface 26 of water 24 than when retracted.

A series of safety nets 32 are located proximate to a perimeter of swimming pool 20. As shown, system 30 includes a plurality of nets 32, each located proximate to one side of pool 20. Nets 32 are arranged such that an entire periphery of swimming pool 20 has a net 32 proximate thereto. Each net 32 has a first edge 31 that is affixed to swimming pool 20 at attachment bracket 36 and a second edge 33 that is attached to a distal end 50 of each actuator rod 48. Second edge 33 is extendable toward the center of swimming pool 20 by the operation of actuators 40 selectively being extended or retracted. Alternatively, attachment bracket can be configured as a retraction reel 36. Retraction reel 36 is rotationally biased, such as with a spring, to maintain net 32 in a retracted position upon the retraction reel 36. As net 32 is extended during extension of actuators 40, net 32 is pulled from retraction reel 36. Nets 32 are constructed of a high strength small mesh such that net 32 is sufficiently strong to support the weight of a person who may have inadvertently fallen into swimming pool 20. The mesh is sufficiently small to prevent the entanglement of a person's extremities therein. Second edge 33 of nets 32 are reinforced with a strong cable or cord 34 typically constructed of a braided or woven flexible synthetic fiber for added tensile strength of second edge 33.

Figure 4:
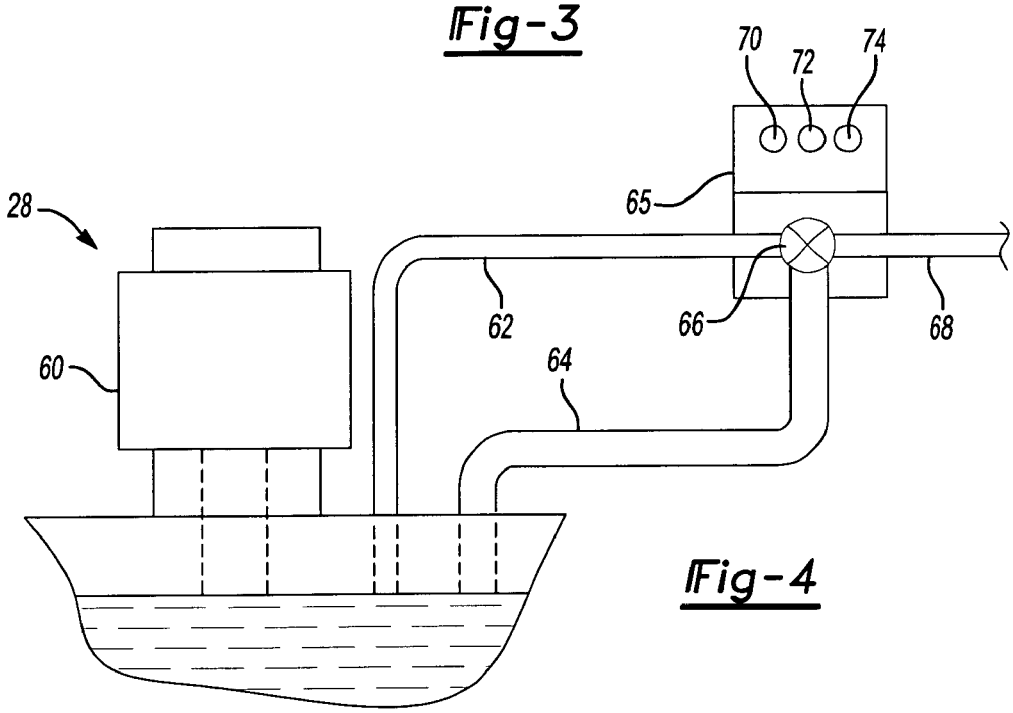
FIG. 4 is an elevational schematic view of the water circulation system for the swimming pool and extendable safety net.

Referring now to FIG. 4, a net controller 65 provides the selective operation of safety net system 30 between extended and retracted positions and also to maintain safety net system 30 in a neutral state to maintain the nets in either their extended or retracted positions. Swimming pool 20 includes a water circulation system 28 for filtering and treating the water 24 in pool 20. Circulation system 28 includes a water circulation pump 60 which further includes a positive pressure port 62 and a negative pressure port 64 for maintaining proper flow of water 24 in pool 28. Ports 62 and 64 are, in turn, also fluidically connected to first and second inlets of control valve 66 of net controller 65. Control valve 66 also includes a net control outlet 68 which is fluidically connected fluid distribution line 52 such that when control valve 66 is fluidically in communication with positive pressure port 62, control outlet 68 and fluid distribution line 52 is positively pressurized and when control valve 66 is fluidically connected to negative pressure port 64, control outlet 68 and fluid distribution line 52 is negatively pressurized. Control valve 66 can be manually activated by rotating a handle to a desired connection of either positive or negative ports 62, 64, respectively, or to a third position wherein control outlet 68 is disconnected from both positive and negative ports 62, 64, respectively. Alternatively, control valve 66 can be electrically controlled by a series of buttons such as "Extend" button 70, "Retract" button 72, and "Off" button 74.

In operation, when an individual desires to use the safety net system to prevent someone from being immersed in the swimming pool 20 in the event of an accidental slip, the individual approaches controller 65 and selects the "Extend" position for control valve 66 by either manually rotating valve 66 or by pressing "Extend" button 70. Upon rotation of valve 66, control outlet port 68 and fluid distribution line 52 are fluidically connected to positive pressure port 62 thereby positively pressurizing fluid distribution line 52. The positively pressurized distribution line 52 causes water to be forced into chamber 46 of each actuator 40 thereby causing piston 44 to axially translate within cylinder housing according to directional arrow "A" (FIG. 2). As piston 44 translates in direction "A", distal end 50 of actuator rod 48 extends from pool sidewall 21 toward the center of swimming pool 20. As distal ends 50 extend toward the center of pool 20, net 32 is also extended thereby providing protection to anyone falling into the pool.

When an individual desires to use swimming pool 20, the user approaches controller 65 and selects the "Retract" position for control valve 66 by either manually rotating valve 66 or by pressing "Retract" button 72. Upon rotation of valve 66, control outlet port 68 and fluid distribution line 52 is negatively pressurized. The negative water pressure in distribution line 52 causes water to be removed from chamber 46 of each actuator 40 forcing piston 44 in direction "B" (FIG. 3). As piston 44 translates in direction "B", distal end 50 of actuator rod 48 retracts from the center of swimming pool 20 toward pool sidewall 21. As distal end 50 retracts, second edge 33 of net 32 is also retracted. As illustrated in FIG. 3, when retracted, net 32 collapses against pool sidewall 21, or when attached to a retraction reel 36, net 32 is rolled thereupon proximate to pool sidewall 21.

Figure 5:
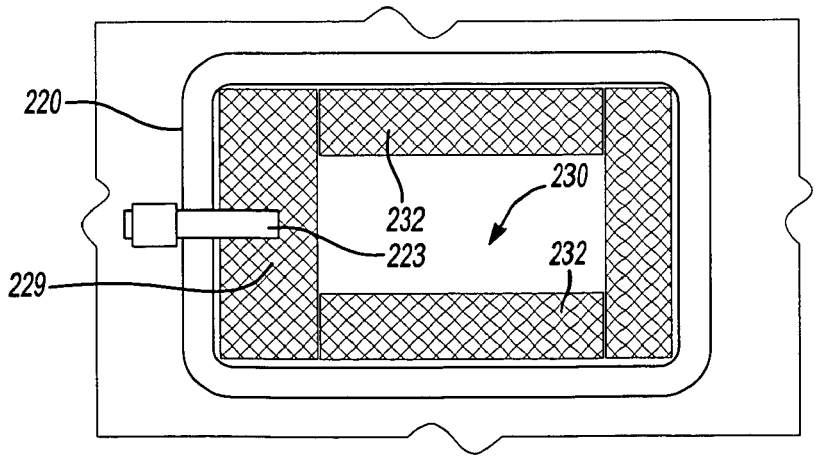
FIG. 5 is a plan view of an in-ground swimming pool having a diving board and incorporating an extendable safety net embodying the present invention.

Turning now to FIG. 5, a pool 220 including diving board 223 is illustrated incorporating pool safety system 230. Safety system 220 is substantially identical to safety system 20 as described above including a series of nets 232; however, since diving board 223 extends toward the center of pool 220, net 229 under diving board 223 has a greater width than nets 232 in order to guard against and support an individual inadvertently falling off diving board 223.

Figure 6:
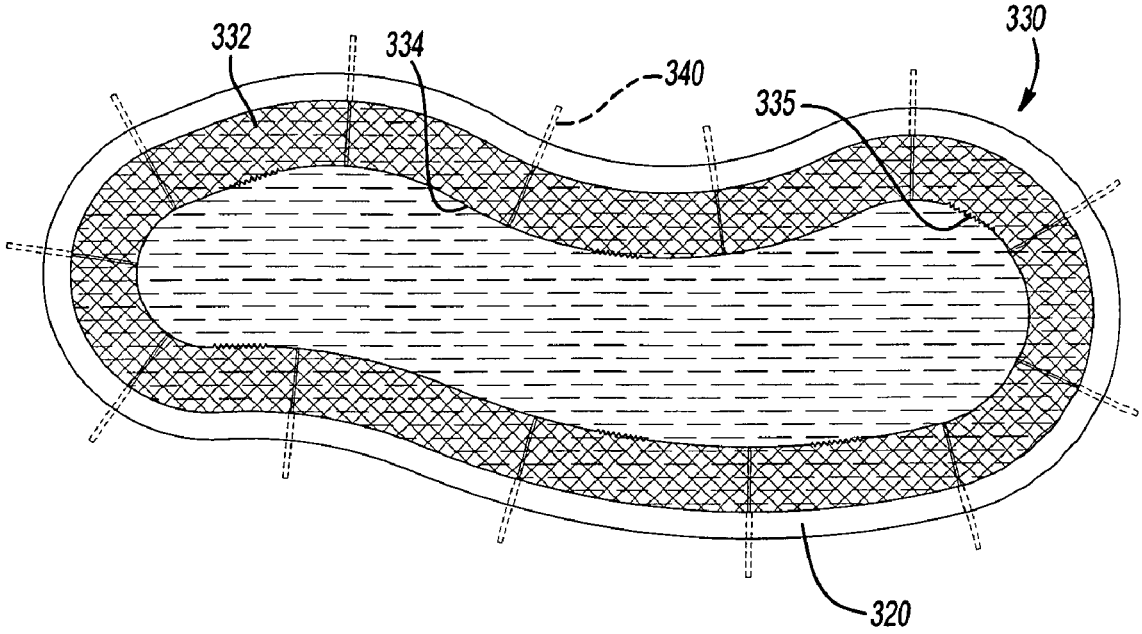
FIG. 6 is a plan view of an irregularly shaped in-ground swimming pool incorporating an extendable safety net.

FIG. 6 illustrates an irregularly shaped pool 320 incorporating a safety system 330 including a plurality of regularly spaced actuators 340 substantially identical in structure and operation as actuators 40 described above for extending and retracting net 332 around an inner periphery of pool 320. Net 332 can be a single net or a plurality of nets arranged in an end-to-end configuration. When net 332 is extended toward the center of irregularly shaped pool 320, the inner circumference of net 332 is smaller than an outer circumference, and thus cable 334 at the inner circumference would become slack and reduce its safety characteristics. Flexible cable 334 can include at least one resilient member 335 for maintaining tension in cable 334 when net 332 is in an extended position. When net 332 is extended, resilient member 335 is more relaxed than when net 332 is retracted, the resiliency compensating for the difference in inner circumference of the extended versus retracted net 332.

Figure 7:
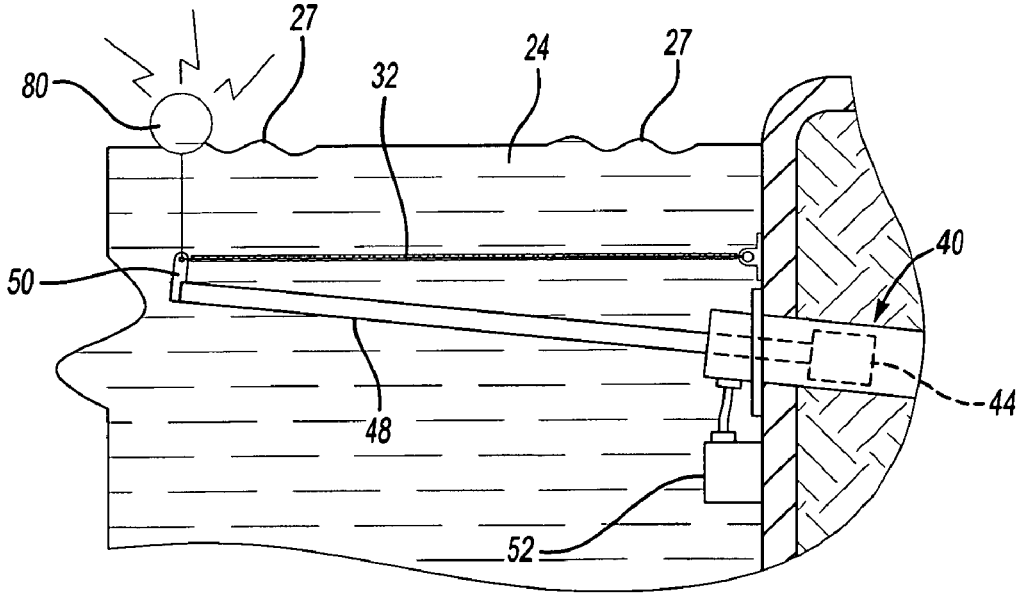
FIG. 7 is a cross-sectional view of the in-ground swimming pool as shown in FIG. 2 incorporating a motion detector warning system.

Turning now to FIG. 7, swimming pool safety net system 30 can also include an alarm system (not shown) of a known configuration. The alarm system is triggered by a motion detector 80 typically affixed to distal end 50 of one or more actuators 40. If an individual accidentally falls into water 24, a series of waves 27 are generated. Motion detector 80 senses the movement of waves 27 as they are propagated across water 24, and upon sensing such movement triggers the alarm system to warn of someone having fallen into the pool. Alternatively, net 32 can be equipped with a weight detector (not shown) to sense the added stress of a fallen individual being supported by net 32, and upon sensing the increased stress triggering the alarm system.

Figure 8:
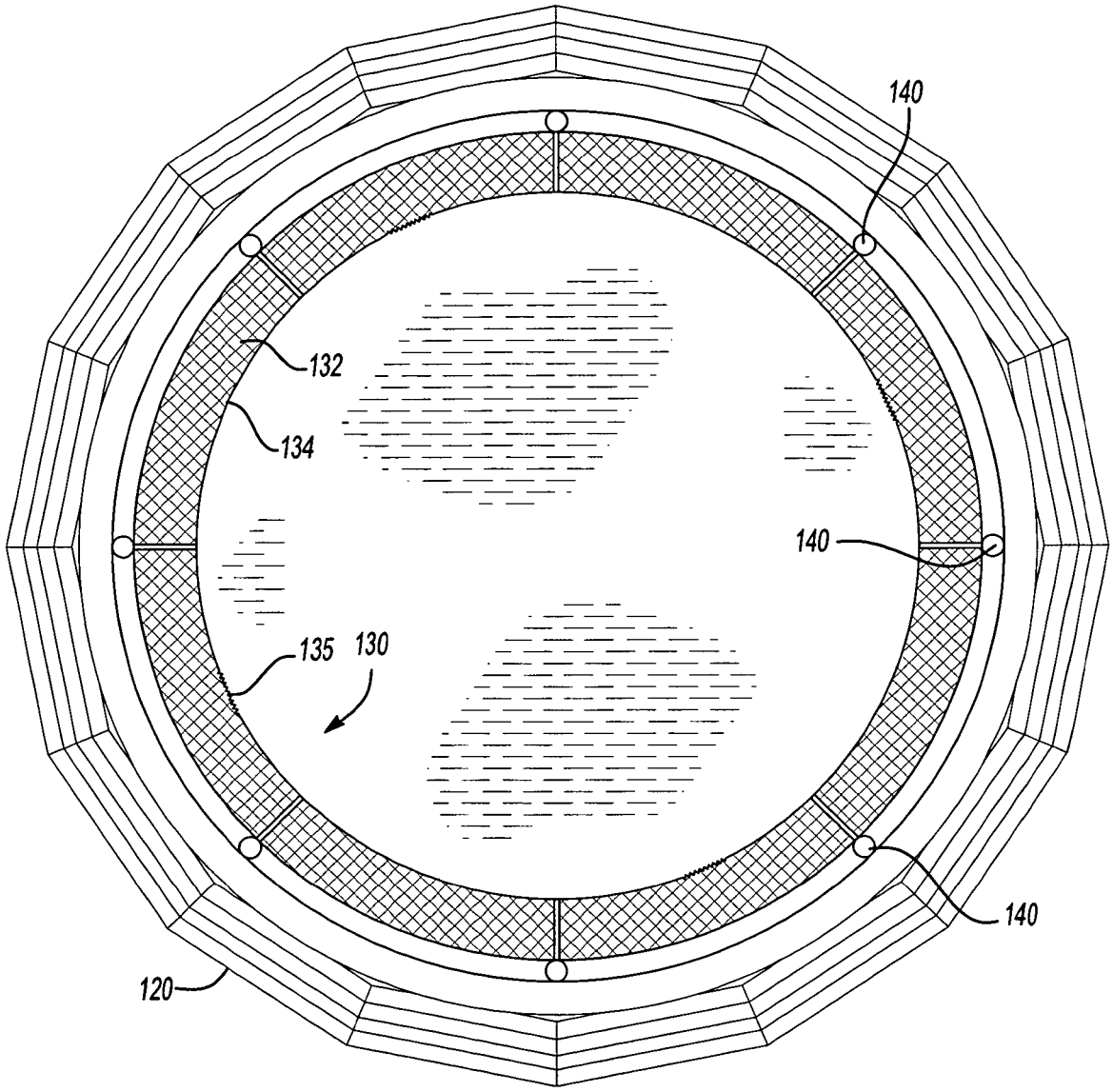
FIG. 8 is an above-ground swimming pool having an extendable safety net embodying the present invention, wherein the safety net is in an extended configuration.
Figure 9:
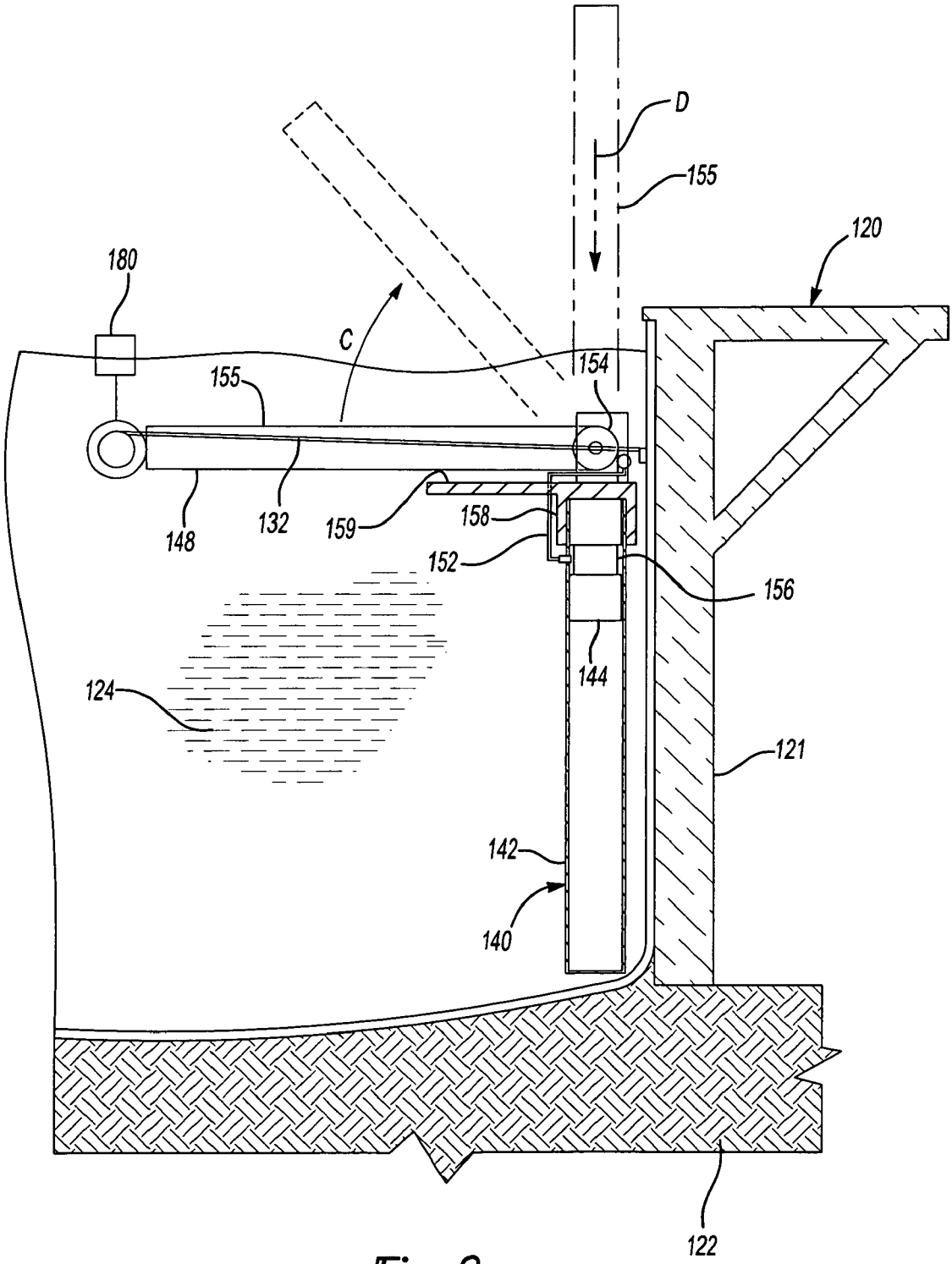
FIG. 9 is a cross-sectional view of an extended cylinder installed in the above-ground swimming pool for the extendable safety net shown in FIG. 8 and taken along the line 9-9, FIG. 8.

FIGS. 8-9 illustrate a swimming pool 120 having an alternate embodiment safety net system 130 installed therein. Safety net system 130 is particularly adaptable to above ground swimming pools and includes a safety net 132 of similar construction as net 32 as described above and is affixed to pool 120 in a similar manner as net 32. Safety net 132 is extended and retracted by a plurality of actuators 140 that are regularly spaced around an inner periphery of pool 120. Since an above ground pool such as pool 120 has relatively thin sidewalls 121, there is insufficient support to embed and orient actuators 140 horizontally as are actuators 40 in system 30, above.

As shown in FIG. 9, each actuator 140 includes a vertically oriented cylinder housing 142 secured to sidewall 121 of pool 120. Cylinder housing 142 receives a piston 144 therein for axial motion therein. Piston 144 has an actuator rod 148 affixed to a top thereof. Actuator rod 148 is comprised of a proximal segment 156 and a distal segment 155. Proximal segment 156 and distal segment 155 are connected one to the other at pivotal joint 154. Cylinder housing 142 also includes a flanged cap 158 affixed to a top portion thereof for retaining piston 144 in cylinder housing 142. Flanged cap 158 includes a flange 159 extending radially therefrom. A fluid distribution line 152 is connected to a controller configured such as controller 65 described above with safety net system 30.

In operation of safety net system 130, a user can select the "Extended" state of the controller whereby the positive pressure port of the water circulation pump is connected to fluid distribution line 152. The positive pressure in fluid line 152 causes the introduction of water into cylinder housing 142 thereby forcing piston 144 and actuator rod 148 to translate upwardly in cylinder housing 142 until actuator rod 148 is fully extended from housing 142. When actuator rod 148 is fully extended above housing 142, pivotal joint 154 is exposed above housing 142 allowing distal segment 155 to pivot downwardly to a horizontal position oriented toward the center of pool 120 as shown in FIG. 9. Since net 132 is affixed to the distal end of distal segment 155, net 132 is in its extended position to guard against the submersion of an individual accidentally falling in pool 120. When horizontally oriented, distal segment 155 contacts, and is supported by, flange 159 of flanged cap 158.

When the user desires to use pool 120, the controller is placed in its "Retracted" state wherein the negative pressure port of the water circulation pump is connected to fluid distribution line 152. Negative pressure then causes water to be extracted from cylinder housing 142 forcing piston 144 downwardly in cylinder housing 142. As piston 144 and proximal segment 155 are drawn downwardly, a pivotal force is generated by flange 159 on distal segment 155 causing distal segment to pivot upwardly according to arrow "C" (FIG. 9). When distal segment 155 is vertically oriented, piston 144, proximal segment 156, and distal segment 155 are withdrawn into cylinder housing 142 according to arrow "D". In this manner, safety net 132 is retracted out of the way of users of the pool until safety net 132 is again desired to be extended as described above.

Alternatively, actuator rod 148 can be a non-pivoting rod such that in its extended mode, actuator rod 148 remains in a vertical orientation wherein safety net 132 is also vertically oriented and blocks entry into pool 120 until safety net system 130 is placed in its retracted mode. In its retracted mode, negative pressure causes water to be removed from cylinder housing 142 forcing piston 144 down and thereby retracting actuator rod 148 into housing 142 thereby lowering safety net 132 and allowing users to enter pool 120.

In climates where freezing weather can be expected during the winter months, safety net systems 30 and 130 will require 'winterization'. For this task, air valves can be added to the net controller 65, distribution lines 52, 152, and actuators 40, 140 to permit the introduction of pressurized air to the system and corresponding exhaust valves to release the water resident in the system. By eliminating water from the actuation elements of safety net systems 30, 130, the freeze-thaw cycle of winter weather will not cause the rupturing and leaking of system elements.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

I claim:

1. A swimming pool safety net system, said system comprising:

a net having a first edge affixable to a side of the swimming pool and a second edge extendable toward a center of the swimming pool;

a plurality of actuators for substantially regularly spacing around a periphery of a swimming pool, each said actuator having an extendable end affixed to said second edge of said net; and a controller connected to a water circulation system of the swimming pool for selective operation of said plurality of actuators between a retracted position with said second end of said net proximal to the side of the swimming pool and an extended position with said second end of said net extended toward a center of the swimming pool.

2. The swimming pool safety net system according to claim 1 wherein said first edge of said net includes a retraction reel.

3. The swimming pool safety net system according to claim 2 wherein said retraction reel is biased to maintain said net in a retracted about said retraction reel.

4. The swimming pool safety net system according to claim 1 wherein said second edge of said net includes a flexible cable.

5. The swimming pool safety net system according to claim 4 wherein said flexible cable includes at least one resilient member for maintaining tension in said cable when said net is in an extended position.

6. The swimming pool safety net system according to claim 1 further including an alarm system for sensing and activating an alarm when an individual falls in the pool on said net.

7. The swimming pool safety net system according to claim 6 wherein said net further includes a motion detector in communication with said alarm system for activating said alarm.

8. The swimming pool safety net system according to claim 6 wherein said net further includes a weight detector in communication with said alarm system for activating said alarm.

9. The swimming pool safety net system according to claim 1 wherein said actuators operate below the water surface of the swimming pool.

10. The swimming pool safety net system according to claim 9 wherein said actuators are embeddable through a side of the swimming pool.

11. The swimming pool safety net system according to claim 10 wherein said actuators are embeddable within an angle of fifteen degrees from horizontal.

12. The swimming pool safety net system according to claim 1 wherein said actuators comprise:

a cylinder housing;

a piston within said cylinder housing and axially movable therein; and an actuator rod affixed to said piston and extending exteriorly to said cylinder housing, said piston rod having a distal end opposite from said piston, said distal end having said second edge of said net affixed thereto.

13. The swimming pool safety net system according to claim 12 wherein said actuators utilize water as an operating medium.

14. The swimming pool safety net system according to claim 13 wherein said actuators are in fluid communication with said controller and further wherein said controller is selectively communicable with the positive and negative pressure ports of the swimming pool circulation pump.

15. The swimming pool safety net system according to claim 14 wherein said controller operates to connect said positive pressure to said actuators to effect extension of said net toward the center of the swimming pool and operates to connect said negative pressure to said actuators to effect retraction of said net away from the center of the swimming pool.

16. The swimming pool safety net system according to claim 12 wherein said actuators are vertically securable at regularly spaced intervals around an interior periphery of the swimming pool and wherein said actuator rod includes a pivot joint proximal to said piston, a proximal segment affixed to said piston and a distal segment pivotal with respect to said proximal segment.

17. The swimming pool safety net system according to claim 16 wherein said distal segment of said actuator rod pivots from vertical to horizontal at full extension of said actuator.

18. The swimming pool safety net system according to claim 17 wherein said cylinder housing includes a support bracket affixed thereto and wherein said distal segment of said actuator rod is supported by said support bracket at full extension of said actuator.

19. A swimming pool safety net system, said system comprising:

a net having a first edge affixed to a side of a swimming pool and a second opposite edge selectively extendable and retractable with respect to said first edge;

a plurality of linear actuators arranged along a length of said net, each said linear actuator including an actuator rod operable between a retracted position and an extended position, a distal end of each said actuator rod attached to said second edge of said net, each said linear actuator secured to an outer perimeter of a swimming pool;

a controller fluidically connected to a swimming pool circulation pump for selectively extending and retracting said net, said controller having a first control inlet connected to a positive pressure outlet of the swimming pool circulation pump for extending said net and a second control inlet connected to a negative pressure outlet of the swimming pool circulation pump for retracting said net, a net control outlet, and a selector for selectively interconnecting said net control outlet with one of said first and said second control inlets; and a fluid line fluidically connecting said net control outlet with each of said plurality of linear actuators.

20. The safety net system according to claim 19 wherein said first edge of said net includes a retraction reel, said retraction reel biased to maintain said net retracted and about said retraction reel.

21. The safety net system according to claim 19 wherein said second edge of said net includes a flexible cable.

22. The safety net system according to claim 21 wherein said flexible cable includes at least one resilient member for maintaining tension in said cable when said net is in an extended position.

23. The safety net system according to claim 19 further including an alarm system for sensing and activating an alarm when an individual falls in the pool on said net.

24. The safety net system according to claim 23 wherein said net further includes a motion detector in communication with said alarm system for activating said alarm.

25. The safety net system according to claim 23 wherein said net further includes a weight detector in communication with said alarm system for activating said alarm.

26. The swimming pool safety net system according to claim 19 wherein said actuators operate below the water surface of the swimming pool.

27. The swimming pool safety net system according to claim 26 wherein said actuators are embeddable through a side of the swimming pool.

28. The swimming pool safety net system according to claim 26 wherein said actuators are vertically secured at regularly spaced intervals around an interior periphery of the swimming pool and wherein said actuator rod includes a pivot joint, a proximal segment affixed to a piston, and a distal segment pivotal with respect to said proximal segment.

29. The swimming pool safety net system according to claim 28 wherein said distal segment of said actuator rod pivots from vertical to horizontal at full extension of said actuator.

30. The swimming pool safety net system according to claim 29 wherein said actuator includes a support bracket affixed externally thereto and wherein said distal segment of said actuator rod is supported by said support bracket at full extension of said actuator.

31. A safety net system for installation in a swimming pool, said safety net system comprising:

a net having a first edge attached to a retraction reel affixed to a side of the swimming pool and a second opposite edge selectively extendable and retractable with respect to said retraction reel;

a plurality of actuators arranged along a length of said net, each said actuator secured to an outer perimeter of the swimming pool and operable between a retracted position and a vertically extended position, a distal end of each said actuator attached to said second edge of said net such that when said actuators are extended, said net vertically blocks entry into the swimming pool;

a net controller fluidically connected to the swimming pool circulation pump for selectively extending and retracting said net, said net controller having a first net control inlet connected to a positive pressure outlet of the swimming pool circulation pump for extending said net and a second net control inlet connected to a negative pressure outlet of the swimming pool circulation pump for retracting said net, a net control outlet, and a selector for selectively interconnecting said net control outlet with one of said first and said second net control inlets; and a fluid line fluidically connecting said net control outlet with each of said plurality of actuators.

* * * * *